US009000658B2

(12) United States Patent
Kunitomo et al.

(10) Patent No.: US 9,000,658 B2
(45) Date of Patent: Apr. 7, 2015

(54) SPARK PLUG FOR INTERNAL COMBUSTION ENGINE

(75) Inventors: Iwao Kunitomo, Aichi (JP); Kenji Ban, Gifu (JP)

(73) Assignee: NGK Spark Plug Co., Ltd., Aichi (JP)

( * ) Notice: Subject to any disclaimer, the term of this patent is extended or adjusted under 35 U.S.C. 154(b) by 170 days.

(21) Appl. No.: 12/937,231

(22) PCT Filed: Apr. 3, 2009

(86) PCT No.: PCT/JP2009/056941

§ 371 (c)(1),
(2), (4) Date: Oct. 8, 2010

(87) PCT Pub. No.: WO2009/125724

PCT Pub. Date: Oct. 15, 2009

(65) Prior Publication Data

US 2011/0025186 A1 Feb. 3, 2011

(30) Foreign Application Priority Data

Apr. 9, 2008 (JP) ..... 2008-100914

(51) Int. Cl.
*H01T 13/32* (2006.01)
*H01T 13/20* (2006.01)

(52) U.S. Cl.
CPC ..... *H01T 13/32* (2013.01); *H01T 13/20* (2013.01)

(58) Field of Classification Search
USPC ..... 313/141, 131 R, 138, 140, 142, 144
See application file for complete search history.

(56) References Cited

U.S. PATENT DOCUMENTS

| | | | | |
|---|---|---|---|---|
| 4,845,400 | A | 7/1989 | Takamura et al. | |
| 5,189,333 | A | 2/1993 | Kagawa et al. | |
| 5,239,225 | A | 8/1993 | Moriya et al. | |
| 2002/0021066 | A1 | 2/2002 | Kanao | |
| 2004/0012318 | A1 | 1/2004 | Ishikawa | |
| 2005/0057135 | A1 * | 3/2005 | Yoshimoto et al. | 313/141 |

(Continued)

FOREIGN PATENT DOCUMENTS

| | | | |
|---|---|---|---|
| EP | 0 479 506 | A1 | 4/1992 |
| JP | 64-27176 | A | 1/1989 |

(Continued)

OTHER PUBLICATIONS

Moriya, Spark Plug for internal combustion engine, JP 04138685, abstract.*

(Continued)

*Primary Examiner* — Nimeshkumar Patel
*Assistant Examiner* — Jacob R Stern
(74) *Attorney, Agent, or Firm* — Sughrue Mion, PLLC

(57) ABSTRACT

A spark plug in which a front end portion of a ground electrode is positioned outside of a virtual outer circumferential face that is formed by extending a front and outer circumferential face of a center electrode in the axis direction, and positioned on a front end side in the axis direction with respect to a virtual face including a front end face of the center electrode. Further, the equation $1.1 \leq b/a \leq 1.6$ is satisfied, where "a" (mm) represents a first minimal distance between the front end portion of the center electrode and the front end portion of the ground electrode and, where "b" (mm) represents a second minimal distance between the front end portion of a ceramic insulator and the front end portion of the ground electrode.

8 Claims, 8 Drawing Sheets

(56) References Cited

U.S. PATENT DOCUMENTS

| | | | | |
|---|---|---|---|---|
| 2006/0163992 | A1* | 7/2006 | Kanao et al. | 313/141 |
| 2006/0220512 | A1* | 10/2006 | Okabe et al. | 313/141 |

FOREIGN PATENT DOCUMENTS

| | | | |
|---|---|---|---|
| JP | 4-94079 | A | 3/1992 |
| JP | 10-50455 | A | 2/1998 |
| JP | 2002-83662 | A | 3/2002 |
| JP | 2002-270333 | A | 9/2002 |
| JP | 2004-55142 | A | 2/2004 |
| JP | 2005-108795 | A | 4/2005 |
| JP | 2006-286468 | A | 10/2006 |

OTHER PUBLICATIONS

Japanese Office Action ("Notification of Reasons for Refusal") dated Oct. 16, 2012 for corresponding Japanese Patent Application No. 2009-533409.

Supplementary European Search Report dated Feb. 12, 2014 for corresponding European Patent Application No. 09729784.

* cited by examiner

Fig. 5
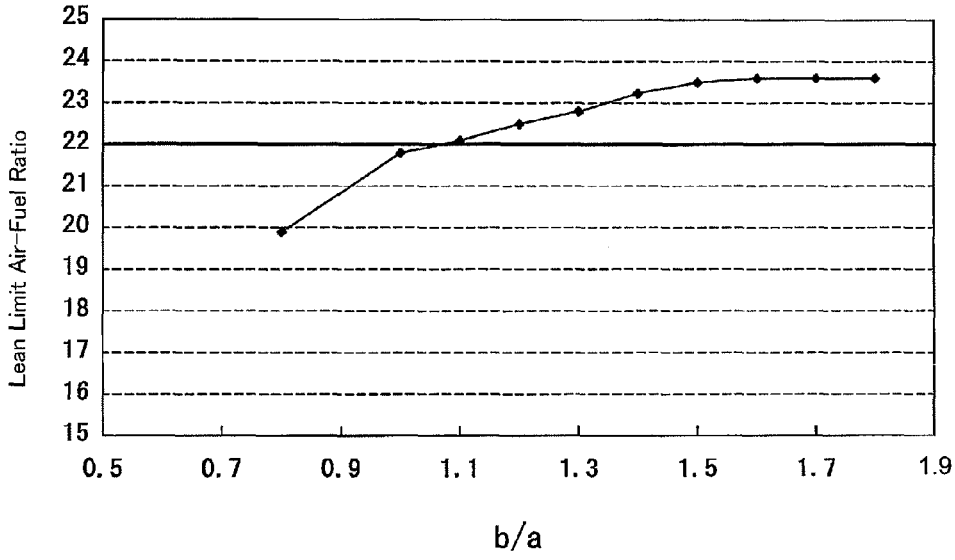
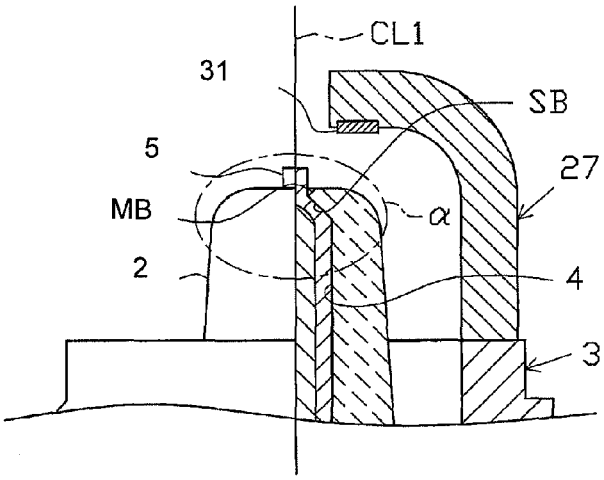
Fig. 6(a)
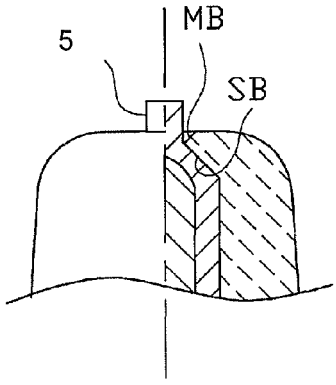
Fig. 6(b)

SPARK PLUG FOR INTERNAL COMBUSTION ENGINE

BACKGROUND OF THE INVENTION

1. Field of the Invention

The present invention relates to a spark plug used for an internal-combustion engine.

2. Description of the Related Art

A spark plug for internal-combustion engines is mounted on an internal-combustion engine, and is used for igniting an air-fuel mixture in a combustion chamber. Generally, a spark plug is comprised of an insulator having an axial bore, a center electrode inserted in a front end of the axial bore, a terminal electrode inserted in a rear end of the axial bore, a metal shell provided in an outer circumference of the insulator and a ground electrode provided on a front end portion of the metal shell, and forming a spark discharge gap with the center electrode.

Along with an operation of an internal-combustion engine, conductive carbon is accumulated on a surface of the insulator. Especially, when a front end of the insulator positioned in a surrounding of the center electrode is covered by carbon, the current applied to the center electrode is transmitted and leaks to the metal shell through the carbon adhered to the front end of the insulator. As a result, a normal spark discharge is less likely conducted (i.e., misfire). Therefore, it is disclosed that the front end portion of the ground electrode is disposed so as to face a side surface of the center electrode, thereby generating the spark discharge between two electrodes through the front end face of the insulator (e.g., refer to Patent Document 1). The conventional art can burn off the carbon adhering to the front end of the insulator at the time of the spark discharge, and excellent anti-fouling characteristics are materialized.

In recent years, improvement in ignitability has been demanded in order to improve fuel consumption and emission reduction. When the above-mentioned conventional art is adopted, a spark discharge is conducted in a position away from the center of a combustion chamber. Thus, there is a possibility that the conventional art may have insufficient ignitability.

Therefore, in order to improve the ignitability, a side portion of a ground electrode is disposed so as to face the front end portion of the center electrode, as well as a noble metal tip having a relatively small diameter is provided on a face opposed to the center electrode or the ground electrode (e.g., refer to Patent Document 2). According to this conventional art, the sparks can be discharged near the center of the combustion chamber. Further, the conventional art can prevent the heat of sparks (flame kernel) from being conducted through the center electrode or the ground electrode.

However, in light of environmental regulations, a direct-injection engine has been used recently in order to facilitate an energy saving and to control discharge of unburnt gas or the like. However, since the direct-injection engine injects fuel into or near a spark discharge gap, carbon tends to be accumulated on a front end portion of an insulator. When the above-mentioned art is adopted, it can hardly burn off the carbon adhering to the front end of the insulator although it can improve ignitability. As a result, anti-fouling characteristics tend to be insufficient which may cause a misfire.

On the other hand, it is disclosed that a position of spark discharge is made near the center of a combustion chamber by disposing a front edge of the ground electrode to face a front edge of the center electrode so that ignitability may improve. Furthermore, the carbon accumulated to the surface of the insulator can be burnt off (e.g., refer to Patent Document 3).

[Patent Document 1] Japanese Patent Application Laid-Open (kokai) No. H10-50455

[Patent Document 2] Japanese Patent Application Laid-Open (kokai) No. 2005-108795

[Patent Document 3] Japanese Patent Application Laid-Open (kokai) No. 2004-55142

3. Problems to be Solved by the Invention

However, in various spark plugs, a position of a front end portion of an insulator in relation to a front end portion of a center electrode vary (e.g., an outer diameter of the front end portion of the center electrode is equal to or differ from an inner diameter of the front end portion of the insulator, or the front end portion of the insulator is close to or away from the front end portion of the center electrode). That is, the conventional art stated in the above-mentioned Patent Document 3, which specified a physical relationship between the center electrode and the ground electrode, is not fully examined about improvement in anti-fouling characteristics. It may not realize the improvement in anti-fouling characteristics in various spark plugs. According to this conventional art, spark discharge is conducted between the insulator and the ground electrode even though the insulator is not fouled. As a result, improvement in ignitability may not fully be demonstrated.

The present invention has been accomplished in view of the foregoing, and an object of the present invention is to provide a spark plug for internal-combustion engines which has an excellent ignitability and a sufficient anti-fouling characteristics regardless of a position of an insulator in relation to a center electrode.

SUMMARY OF THE INVENTION

Configurations suitable for achieving the above-described objects will be described in an itemized fashion. Notably, when necessary, action and effects peculiar to each configuration will be added.

First aspect: A spark plug for an internal-combustion engine according to the present invention, comprising: a rod-like center electrode extending in an axis direction; an insulator having an axial bore in the axis direction in which the center electrode is inserted; a generally cylindrical metal shell provided on an outer circumference of the insulator; a ground electrode extending from a front end portion of the metal shell and disposed so that a front end thereof is bent toward the center electrode; and a gap formed between the ground electrode and the center electrode, wherein a front end portion of the ground electrode is positioned outside of a virtual outer circumferential face that is formed by extending a front end outer circumferential face of the center electrode in the axis direction, and positioned on a front end side in the axis direction with respect to a virtual face including a front end face of the center electrode, and wherein the present invention satisfies the following equation, $1.1 \leq b/a \leq 1.6$, where "a" (*mm*) represents a first minimal distance between the front end portion of the center electrode and the front end portion of the ground electrode, and where "b" (*mm*) represents a second minimal distance between the front end portion of the insulator and the front end portion of the ground electrode.

In addition, a noble metal portion made of a noble metal alloy, such as a noble metal tip, may be formed on the center electrode and the ground electrode. In this case, the noble metal portion constitutes a part of the center electrode or the ground electrode.

According to the first aspect, the ground electrode is positioned such that the front end portion thereof is outside of the virtual outer circumferential face formed by extending the front end outer circumferential face of the center electrode in the axis direction, and is positioned on the front end side in the axis direction with respect to the virtual face including the front end face of the center electrode. In this way, a spark discharge can be generated near the center of a combustion chamber with respect to the front end face of the center electrode. As a result, improvement in ignitability is achievable.

According to the first aspect, the present invention satisfies the equation: $1.1 \leq b/a \leq 1.6$, where "a" (*mm*) represents the first minimal distance between the front end portion of the center electrode and the front end portion of the ground electrode, and where "b" (*mm*) represents the second minimal distance between the front end portion of the insulator and the front end portion of the ground electrode. That is, the second minimal distance falls within a range from 1.1 times or more to 1.6 times or less of the first minimal distance.

Since the second minimal distance is set to be 1.1 times or more, the spark discharge is readily generated without creeping on the insulator between the center electrode and the ground electrode with a relatively short distance, when the front end face of the insulator is not fouled with carbon (normal time). That is, spark discharge with excellent ignitability can be realized at a normal time near the center of the combustion chamber as mentioned above.

On the other hand, since the second minimal distance is set to be 1.6 times or less of the first minimal distance, spark discharge tends to be generated through creeping on the insulator when the front end face of the insulator is fouled with carbon (at the time of fouling). Thus, the carbon adhering to the insulator can be burnt off, and improvement in anti-fouling characteristics is achievable.

According to the first aspect, the first minimal distance "a" and the second minimal distance "b" are defined so that the equation of $1.1 \leq b/a \leq 1.6$ is satisfied. Therefore, the spark discharge can be generated between two electrodes without creeping on the insulator at the normal time. Also, the spark discharge can be generated between two electrodes through creeping on the insulator at the time of carbon fouling. As a result, improvement in both excellent ignitability and anti-fouling characteristics is achievable.

When the second minimal distance is less than 1.1 times of the first minimal distance (i.e., $1.1 > b/a$), the spark discharge tends to be generated through creeping on the insulator, which leads to deterioration in ignitability. On the other hand, when the second minimal distance exceeds 1.6 times of the first minimal distance (i.e., $b/a > 1.6$), the spark discharge is less likely to be generated through creeping on the insulator at the time of carbon fouling. Thus, anti-fouling characteristics is possibly deteriorated.

Second aspect: In the first aspect, the spark plug for an internal-combustion engine according to a second aspect satisfies an equation: $1.5 \leq b/a \leq 1.6$.

According to the second aspect, excellent ignitability can be further achieved while maintaining the excellent anti-fouling characteristics.

Third aspect: In the first or second aspect, the spark plug for an internal-combustion engine according to a third aspect, wherein, when a front end opening of the axial bore and a corner positioned closest to the front end portion of the center electrode are projected on a virtual projection face perpendicular to the axis, an outer circumference length L of a projected axial bore between a first contact point and a second contact point on the ground electrode side occupies 40% or more of the outer circumference length of the projected axial bore, where the first contact point is defined by a first tangent drawn from a first edge that is positioned on an end of a projected corner serving as the corner projected on the virtual projection face to the projected axial bore serving as the front end opening of the axial bore projected on the virtual projection face, where the second contact point is defined by a second tangent drawn from a second edge that is positioned in the other end of the projected corner to the projected axial bore.

In addition, two tangents can be drawn from the first edge and the second edge to the projected axial bore, respectively. The "first tangent" and the "second tangent" in the second aspect mean two tangents which do not intersect between the projection corner and the projected axial bore (the same applicable hereinafter).

According to the third aspect, a proportion of the outer circumference length L of the projected axial bore between the first and second contact points on the ground electrode side with respect to the outer circumference length of the projected axial bore (hereinafter referred to as an "electrode facing proportion") is 40% or more. That is, the spark discharge can be generated through creeping on a portion which occupies about 40% or more of the insulator that is positioned around the center electrode. Thus, an area where the carbon is burnt off at the time of the carbon fouling becomes relatively wide, resulting in further improvement in anti-fouling characteristics.

In the case where a plurality of ground electrodes is provided, the total length between the contact points of the projected axial bore on the ground electrode side in each ground electrode may occupy 40% or more of the outer circumferential length of the projected axial bore. However, when a portion constituting a length between the contact points corresponding to a ground electrode overlaps a portion constituting a length between the contact points corresponding to another ground electrode, the overlapped portion is excluded for the calculation of the total length between the contact points. Therefore, the upper limit of the total length between the contact points is equal to a length of the outer circumferential length of the projected axial bore, and the upper limit of the electrode facing proportion is 100%.

Fourth aspect: In the third aspect, the spark plug for an internal-combustion engine according to a fourth aspect, wherein the length L between the first and second contact points along the outer circumference of the projected axial bore on the ground electrode side occupies 50% or more of the outer circumference length of the projected axial bore.

According to the fourth aspect, an area where the carbon can be burnt off becomes wide. Thus, improvement in anti-fouling characteristics can be facilitated.

Fifth aspect: In any one of aspects 1 to 4, the spark plug for an internal-combustion engine according to a fifth aspect includes a tapered portion in a front end portion of the axial bore that tapers off toward the front end in the axis direction.

According to the fifth aspect, since the tapered portion which tapers off towards the front end in the axis direction is formed in the front end portion of the axial bore, an annular region (area) of the insulator corresponding to a circumference of the center electrode is made relatively small. Thus, the carbon adhering to the surface of the annular area can be efficiently burnt off with a relatively fewer spark discharges. As a result, further improvement in anti-fouling characteristics is achievable.

When adopting the fifth aspect, the front end portion of the center electrode is reduced in diameter. When the entire center electrode diameter is reduced, there is a possibility that heat conduction of the center electrode may deteriorate. Therefore, it is preferred that only the front end portion of the center electrode be reduced in diameter so as to correspond to a shape of the front end portion of the axial bore. As a result, heat conduction of the center electrode can be fully maintained.

Sixth aspect: In any one of aspects 1 to 5, the spark plug for an internal-combustion engine according to a sixth aspect, the spark plug is provided with a chamfered portion in a front end opening of the axial bore.

When the spark discharge is generated through creeping on the surface of the insulator, a channeling that damages the surface of the insulator in a groove shape tends to occur. According to the sixth aspect, since the chamfered portion is formed in the front end opening of the axial bore, current path where the current flows on the insulator surface can be divided. Thereby, the channeling can be assuredly prevented, and uneven erosion of the center electrode induced by spark discharge can be controlled. As a result, improvement in durability is facilitated.

Seventh aspect: In any one of aspects 1 to 6, the spark plug for an internal-combustion engine according to a seventh aspect is provided with a plurality of ground electrodes.

According to the seventh aspect, since a wider surface area of the insulator which is fouled by carbon can be burnt off, further improvement in anti-fouling characteristics is achievable.

Eighth aspect: In any one of aspects 1 to 7, the spark plug for an internal-combustion engine according to an eighth aspect, wherein the center electrode has a noble metal portion on the front end portion thereof.

The "noble metal portion" is made of a noble metal as a single element or an alloy containing a noble metal. Examples of the noble metal include platinum, iridium or the like (also applicable to hereinafter).

According to the eighth aspect, the center electrode has the noble metal portion made of a noble metal alloy on the front end portion thereof. Thus, improvement in spark erosion resistance is achievable and the durability is further enhanced.

Ninth aspect: In any one of aspects 1 to 8, the spark plug for an internal-combustion engine according to a ninth aspect, wherein a noble metal portion is provided on a portion of the ground electrode which faces a front edge of the center electrode.

According to the ninth aspect, since the ground electrode has the noble metal portion made of a noble metal alloy on the portion facing the front edge (corner) of the center electrode, further improvement in spark erosion resistance is achievable. As a result, the durability is further enhanced.

Tenth aspect: In any one of aspects 1 to 9, the spark plug for an internal-combustion engine according to a tenth aspect, wherein the center electrode has a noble metal portion on at least a part of a portion facing the front end opening of the axial bore.

According to the tenth aspect, the center electrode has the noble metal portion on at least a part of the portion facing the front end opening of the axial bore. Thus, erosion of a side face of the center electrode can be prevented when the spark discharge is generated between two electrodes through creeping on the carbon. As a result, improvement in durability can be further facilitated.

BRIEF DESCRIPTION OF THE DRAWINGS

FIG. 5 is a graph showing a result of ignitability test.

FIG. 6(*a*) is an expanded sectional view showing a front end portion of the spark plug according to another embodiment, and FIG. 6(*b*) is an expanded sectional view showing an axial bore or the like on an alpha area of FIG. 6(*a*).

DETAILED DESCRIPTION OF THE PREFERRED EMBODIMENTS

Description of Reference Numerals

Figure 1:
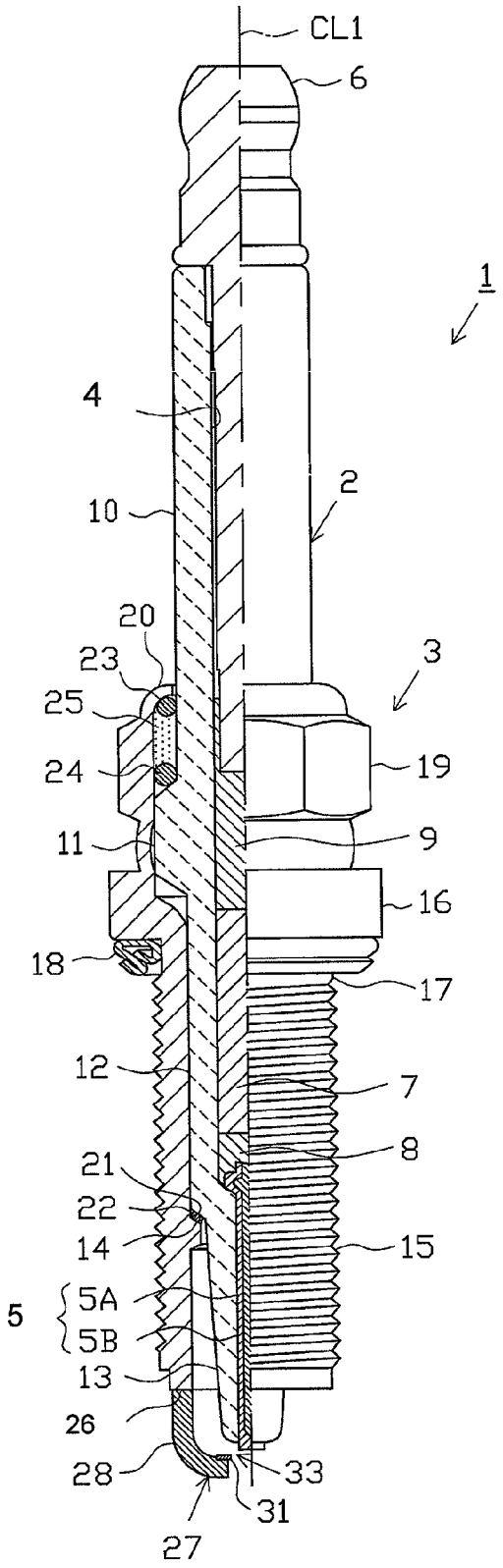
FIG. 1 is a partially sectioned front view of a spark plug according to an embodiment.

Reference numerals used to identify various structural features in the drawings including the following.

1: Spark plug for internal-combustion engine
2: Ceramic insulator as an insulator
3: Metal shell
4: Axial bore
5: Center electrode
5G: Front end outer circumferential face of the center electrode
27, 27*a*, 27*b*: Ground electrode
31, 32, 34: Noble metal portion
33: Spark discharge gap as a gap
35, 35*a*: Corner
BP: Projected axial bore
CL1: Axis
EG1: First edge
EG2: Second edge
KG: Virtual outer circumferential face
KS: Virtual face
KT: Virtual projection face
MB: Chamfered portion
SB: Tapered portion
SL1: First tangent
SL2: Second tangent
SP1: First contact point
SP2: Second contact point
TC: Projected corner An embodiment will now be described with reference to the drawings. FIG. 1 is a partially sectioned front view showing a spark plug 1. Notably, in FIG. 1, the spark plug 1 is depicted in such a manner that the direction of an axis CL1 of the spark plug 1 coincides with the vertical direction in FIG. 1. Further, in the following description, the lower side of FIG. 1 will be referred to as the front end side of the spark plug 1, and the upper side of FIG. 1 will be referred to as the rear end side of the spark plug 1.

The spark plug 1 is composed of a cylindrical ceramic insulator 2 serving as an insulator, a cylindrical metal shell 3 which holds the ceramic insulator 2, etc.

As well known, the ceramic insulator 2 is made of alumina or the like through firing. The ceramic insulator 2 includes a rear-end-side trunk portion 10 formed on the rear end side; a larger diameter portion 11 projecting radially outward on the front end side of the rear-end-side trunk portion 10; an intermediate trunk portion 12 formed on the front end side of the larger diameter portion 11 and having a diameter smaller than that of the larger diameter portion 11; and a leg portion 13 formed on the front end side of the intermediate trunk portion 12 and having a diameter smaller than that of the intermediate trunk portion 12. Of the ceramic insulator 2, the larger diameter portion 11, the intermediate trunk portion 12, and the greater part of the leg portion 13 are accommodated within the metal shell 3. A tapered step portion 14 is formed at a connection portion between the leg portion 13 and the intermediate trunk portion 12. The ceramic insulator 2 is engaged with the metal shell 3 at the step portion 14.

Furthermore, the ceramic insulator 2 has an axial hole 4 which penetrates the ceramic insulator 2 along the axis CL1. A center electrode 5 is inserted into and fixed to a front end portion of the axial hole 4. The center electrode 5 is composed of an inner layer 5A formed of copper or a copper alloy, and an outer layer 5B formed of a nickel alloy whose predominant component is nickel (Ni). The center electrode 5 assumes a rod-like shape (cylindrical columnar shape) as a whole. A front end portion of the center electrode 5 is made flat and projects from the front end of the ceramic insulator 2.

A terminal electrode 6 is fixedly inserted into a rear end portion of the axial hole 4 such that the terminal electrode 6 projects from the rear end of the ceramic insulator 2.

Furthermore, a cylindrical columnar resistor 7 is disposed in the axial hole 4 between the center electrode 5 and the terminal electrode 6. Opposite ends of the resistor 7 are electrically connected to the center electrode 5 and the terminal electrode 6, respectively, via electrically conductive glass seal layers 8 and 9.

In addition, the metal shell 3 is formed of metal such as low carbon steel and has a cylindrical shape. A thread portion (external thread portion) 15 for mounting the spark plug 1 onto an engine head is formed on the outer circumferential surface thereof. Further, a seat portion 16 is formed on the outer circumferential surface located on the rear end side of the thread portion 15, and a ring-shaped gasket 18 is fitted into a thread neck potion 17 at the rear end of the thread portion 15. Moreover, a tool engagement portion 19 and a crimped portion 20 are provided at the rear end of the metal shell 3. The tool engagement portion 19 has a hexagonal cross section, and a tool, such as a wrench, is engaged with the tool engagement portion 19 when the spark plug 1 is mounted to the engine head. The crimped portion 20 holds the ceramic insulator 2 at the rear end portion.

Furthermore, a tapered step portion 21 with which the ceramic insulator 2 is engaged is provided on the inner circumferential surface of the metal shell 3. The ceramic insulator 2 is inserted into the metal shell 3 from its rear end side toward the front end side. In a state in which the step portion 14 of the ceramic insulator 2 is engaged with the step portion 21 of the metal shell 3, a rear-end-side opening portion of the metal shell 3 is crimped radially inward; i.e., the above-mentioned crimped portion 20 is formed, whereby the ceramic insulator 2 is held by the metal shell 3. Notably, an annular plate packing 22 is interposed between the step portions 14 and 21. Thus, the airtightness of a combustion chamber is secured, whereby an air-fuel mixture which enters the clearance between the inner circumferential surface of the metal shell 3 and the leg portion 13 of the ceramic insulator 2 exposed to the interior of the combustion chamber is prevented from leaking to the outside.

Moreover, in order to render the sealing by the crimping more perfect, on the rear end side of the metal shell 3, annular ring members 23 and 24 are interposed between the metal shell 3 and the ceramic insulator 2, and powder of talc 25 is charged into the space between the ring members 23 and 24. That is, the metal shell 3 holds the ceramic insulator 2 via the plate packing 22, the ring members 23 and 24, and the talc 25.

A ground electrode 27 made of a Ni alloy is joined to a front end portion 26 of the metal shell 3. The ground electrode 27 is composed of: a ground electrode main body 28 in which a rear end portion thereof is welded to a front end face of the front end portion 26 of the metal shell 3, and a front end thereof is bent such that a side surface thereof faces a front edge of the center electrode 5; and a noble metal portion 31 formed of a noble metal alloy (e.g., a platinum alloy or an iridium alloy) and joined to a front end portion of the ground electrode main body 28.

Further, the noble metal portion 31 has a width perpendicular to the axis CL1 and wider than an outer diameter of the center electrode 5. Furthermore, a part of an end of the noble metal portion 31 is embedded into a side face of the ground electrode main body 28 on the center electrode 5 side, and the other end of the noble metal portion 31 projects from the front end face of the ground electrode main body 28. A spark discharge gap 33 serving as a gap is provided between the front end portion of the ground electrode 27 (the noble metal portion 31) and the front end portion of the center electrode 5.

Figure 2:
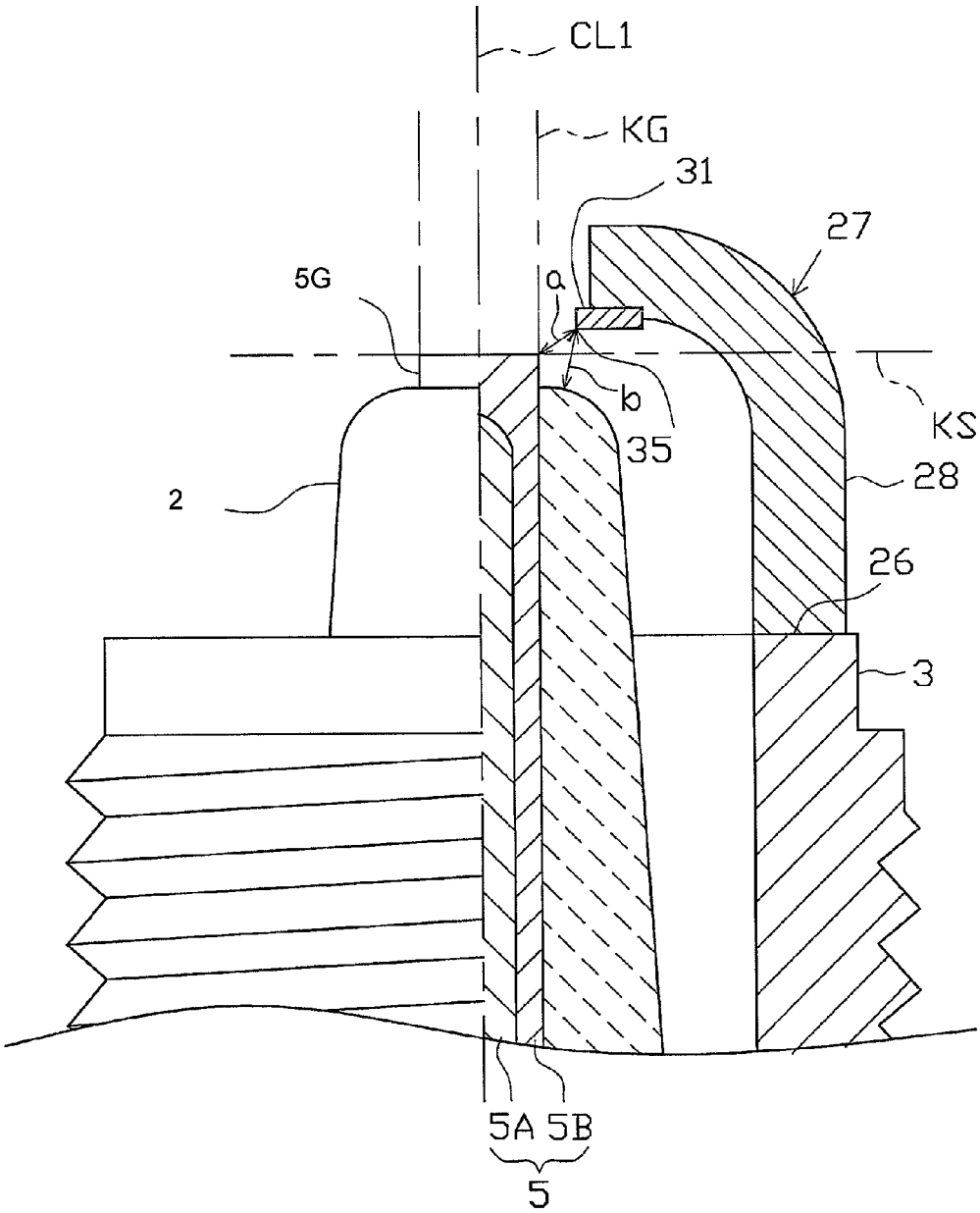
FIG. 2 is a partially sectioned enlarged view of a front end portion of the spark plug.

Further, in this embodiment, as shown in FIG. 2, the ground electrode 27 is positioned such that the front end portion thereof is outside of a virtual outer circumferential face KG and is positioned on the front end side with respect to a virtual face KS in the axis CL1 direction. The virtual outer circumferential face KG is formed by extending a front end outer circumferential face 5G of the center electrode 5 in the axis CL1 direction, and the virtual face KS includes the front end of the center electrode 5.

In addition, the present invention satisfies an equation of $1.1 \leq b/a \leq 1.6$, where "a" (*mm*) represents a first minimal distance that is the minimal distance between the front end portion of the center electrode 5 and the front end portion of the ground electrode 27 (noble metal portion 31), where "b" (mm) represents a second minimal distance that is the minimal distance between the front end portion of the ceramic insulator 2 and the front end portion of the ground electrode 27 (i.e., the second minimal distance falls within the range from 1.1 times or more to 1.6 times or less (e.g., 1.3 times) of the first minimal distance). In this embodiment, the first minimal distance is defined between a corner 35 of the noble metal portion 31 and the front end portion of the center electrode 5, and the second minimal distance is defined between the corner 35 of the noble metal portion 31 and the front end portion of the ceramic insulator 2. That is, each reference point of the first minimal distance and the second minimal distance is the same on the ground electrode 27 side.

Figure 3:
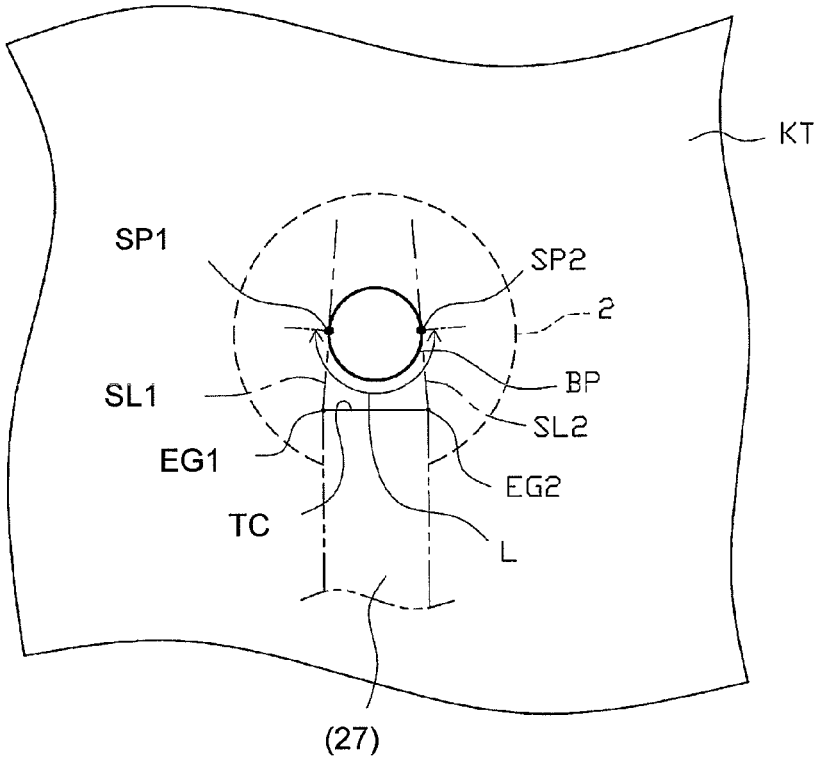
FIG. 3 is a diagram showing an axial bore and a ground electrode or the like which are projected on a virtual projection surface.

The center electrode 5 and the ground electrode 27 or the like in this embodiment have the following positional relationship. As shown in FIG. 3, in the front end portion of the ground electrode 27, the corner 35 positioned closest to the front end portion of the center electrode 5 and a front end opening of the axial bore 4 are projected on a virtual projection face KT that is perpendicular to the axis CL1. A first tangent SL1 (indicated by a thick line in the drawing) is drawn from a first edge EG1 positioned on an end of a projected corner TC, which serves as the corner 35 projected on the virtual projection face KT, to a projected axial bore BP serving as the front end opening of the axial bore 4, which is projected on the virtual projection face KT. Further, a second tangent SL2 is drawn from a second edge EG2 positioned in the other end of the projected corner TC to the projected axial bore BP. A contact point between the projected axial bore BP and the first tangent SL1 serves as a first contact point SP1, and a contact point between the projected axial bore BP and the second tangent SL2 serves as a second contact point SP2. A proportion of an outer circumference length L of the projected axial bore BP between the first and second contact points SP1, SP2 on the ground electrode 27 side with respect to the outer circumference length of the projected axial bore BP (hereinafter referred to as "electrode facing proportion") is 40% or more (e.g., 50%).

Figure 4:
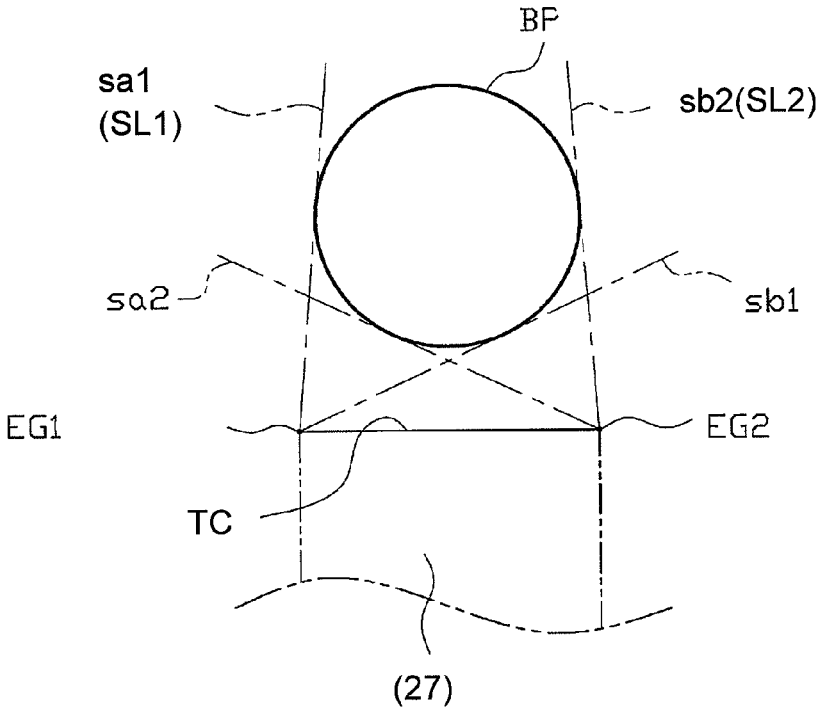
FIG. 4 is a diagram for explaining a first tangent and a second tangent.

As shown in FIG. 4, two tangents sa1 and sb1 can be drawn from the first edge EG1 to the projected axial bore BP. Further, two tangents sa2 and sb2 can be drawn from the second edge EG2 to the projected axial bore BP. The terms "first tangent SL1" and the "second tangent SL2" in this embodiment mean two tangents sa1, sb2 which do not intersect between the projection corner TC and the projected axial bore BP.

Next, in order to confirm the effects of the spark plug 1 having the above-described configuration according to the embodiment, the following tests were conducted. Samples of spark plug were produced for an anti-fouling test and an ignitability test. The samples had various ratio (b/a) of the second minimal distance to the first minimal distance between 1.0 and 1.8. The anti-fouling test is conducted according to Japanese Industrial Standard D1606 (carbon-fouling test). More particularly, a test car where four spark plugs were mounted on each cylinder of a 4-cylinder engine (1600 cc displacement), respectively, is located on a chassis dynamometer in a low-temperature-test room (at −10 degrees C.). After pressing down on an accelerator for 3 times, the test car ran for 40 seconds at 35 km/h with the 3rd gear, and again ran for 40 seconds at 35 km/h with the 3rd gear following the idling for 90 seconds. Thereafter, the engine was stopped for cooling down. Subsequently, the test car ran for 20 seconds at 15 km/h with the first gear after pressing down on the accelerator for 3 times and the engine was stopped for 30 seconds. The same procedure was conducted in total 3 times. These series of test pattern was counted as one cycle, and 10 cycles were conducted for the test. Thereafter, the insulation resistance value between the metal shell and the terminal electrode in the predetermined samples was measured. A sample having the insulation resistance value of over 10 M ohm evaluated "○", representing excellent anti-fouling characteristics. On the other hand, a sample having the insulation resistance value of less than 10 M ohm evaluated "x", representing poor anti-fouling characteristics.

Next, in an ignitability test, each sample was mounted on a 6-cylinder DOHC engine with a displacement of 2000 cc. The engine was rotated at 2000 rpm, a suction negative pressure of −350 mmHg, and an air-fuel ratio (A/F) was raised gradually. The air-fuel ratio when 1% misfiring occurred was measured as a lean limit air-fuel ratio. When the lean limit air-fuel ratio was 22.0 or more, "○" was awarded, representing good ignitability. When the lean limit air-fuel ratio was 23.5 or more, "◎" was awarded, representing excellent ignitability. On the other hand, when the lean limit air-fuel ratio was less than 22.0, "x" was awarded, representing poor ignitability. The result of the anti-fouling test and the ignitability test is shown in Table 1. Further, FIG. 5 shows the result of ignitability test. In addition, each sample included the front end portion of the center electrode which had a projection length of 1.5 mm from the ceramic insulator and the outer diameter of 2.0 mm.

TABLE 1

| Sample No. | 1 | 2 | 3 | 4 | 5 | 6 | 7 | 8 | 9 |
|---|---|---|---|---|---|---|---|---|---|
| b/a | 1 | 1.1 | 1.2 | 1.3 | 1.4 | 1.5 | 1.6 | 1.7 | 1.8 |
| Anti-fouling test | ○ | ○ | ○ | ○ | ○ | ○ | ○ | X | X |
| Ignitability test | X | ○ | ○ | ○ | ○ | ◎ | ◎ | ◎ | ◎ |

As shown in Table 1, the samples having the b/a value of over 1.6 (sample 8, 9) exhibited the insulation resistance of less than 10 M ohm, representing poor anti-fouling characteristics. This is because the distance between the front end portion of the insulator and the front end portion of the ground electrode was too far, resulting in a spark discharge between two electrodes through creeping on the insulator being difficult to occur.

On the other hand, the samples having the b/a value of 1.0 or more to 1.6 or less (samples 1, 2, 3, 4, 5, 6 and 7) exhibited the insulation resistance of 10M ohm or more, representing good anti-fouling characteristics. This is because a spark discharge was readily generated between two electrodes through creeping on the insulator, and the carbon adhering to the front end of the insulator could be burnt off when the front end of the insulator is fouled by carbon.

In addition, as shown in Table 1 and FIG. 5, the sample having the b/a value of less than 1.1 (sample 1) exhibited poor ignitability. This is because a spark discharge was readily generated between two electrodes through creeping on the insulator even if the front end of the insulator was not fouled by carbon (in normal state).

On the other hand, the samples having the b/a value of 1.1 or more to 1.8 or less (samples 2-9) exhibited good ignitability. This is because a spark discharge was readily generated between two electrodes without creeping on the insulator at a normal time. Further, the samples having the b/a value of 1.5 or more (samples 6-9) exhibited excellent ignitability.

Considering the results of the tests comprehensively, it is preferable that the b/a value be 1.1 or more to 1.6 or less in order to realize both outstanding anti-fouling characteristics and excellent ignitability. Moreover, in order to further improve ignitability while maintaining the outstanding anti-fouling characteristics, it is preferable that the b/a value be 1.5 or more to 1.6 or less.

Subsequently, samples of spark plug were produced for the anti-fouling test. The shapes of the ground electrode and the center electrode were changed, and various number of the ground electrodes were formed so that the samples had various proportion of the outer circumference length of the projected axial bore between the first and second contact points SP1, SP2 to the outer circumference length of the projected axial bore (the electrode facing proportion). When the insulation resistance value after 10 cycles was 10 M ohm or more, "○" was awarded for good anti-fouling characteristics. When the insulation resistance value after 11 to 15 cycles was 10 M ohm or more, "◎" was awarded for excellent anti-fouling characteristics. Further, when the insulation resistance value after 16 cycles was 10 M ohm or more, "☆" was awarded for extremely excellent anti-fouling characteristics. In each sample, the b/a value was 1.1 or more to 1.6 or less. The samples 10-14 had a single ground electrode, and the sample 15 had two ground electrodes therein. The result of the evaluation test is shown in Table 2.

TABLE 2

| Sample No. | 10 | 11 | 12 | 13 | 14 | 15 |
|---|---|---|---|---|---|---|
| Electrode facing proportion (%) | 20 | 30 | 40 | 50 | 60 | 80 |
| Anti-fouling Test | ○ | ○ | ◎ | ☆ | ☆ | ☆ |

As shown in Table 2, each sample (the samples 10 to 15) exhibited good anti-fouling characteristics. The samples having the electrode facing proportion of 40% or more (the samples 12-15) exhibited excellent anti-fouling characteristics with the insulation resistance value of 10 M ohm or more. This is because a space between the center electrode and the ground electrode where a spark discharge occurs is made relatively wide. Thus, an area where the carbon is burnt off becomes wide. Further, the samples having the electrode facing proportion of 50% or more (the samples 13-15) maintained the insulation resistance value of 10 M ohm or more for 16 cycles or more, exhibiting extremely excellent anti-fouling characteristics. Therefore, in light of further improvement in anti-fouling characteristics, it is preferable that the electrode facing proportion be 40% or more, more preferably 50% or more.

Notably, the present invention is not limited to the details of the above-described embodiments, and may be practiced as follows. Needless to say, other applications and modifications which are not described below are possible.

(a) In the above-mentioned embodiment, the front end portion of the axial bore 4 has the generally uniform inner diameter, and the front end portion of the center electrode 5 also has the generally uniform outer diameter. On the other hand, as shown in FIGS. 6(*a*) and (*b*) (FIG. 6(*b*) is the enlarged sectional view of an area "a" in FIG. 6(*a*)), a tapered portion SB tapering off toward the front end side in the axis CL1 direction may be formed in the front end portion of the axial bore 4. Also, the center electrode 5 may assume a tapered shape toward the front end side so as to correspond to the shape of the axial bore 4. In this case, an annular region (area) of the ceramic insulator 2 corresponding to a circumference of the center electrode 5 is made relatively small. Thus, the carbon adhering to the surface of the annular area can be efficiently burnt off with relatively fewer spark discharges. As a result, further improvement in anti-fouling characteristics is achievable.

Further, in the above-mentioned embodiment, the front end opening of the axial bore 4 has a generally right angle in the cross section. However, it may have a chamfered portion MB in the front end opening of the axial bore 4. In this case, a channeling can be assuredly prevented, resulting in improvement in durability. In FIG. 6, although the chamfered portion MB is formed in the shape of a curving surface, it may be formed in a tapered shape or the like.

Figure 7:
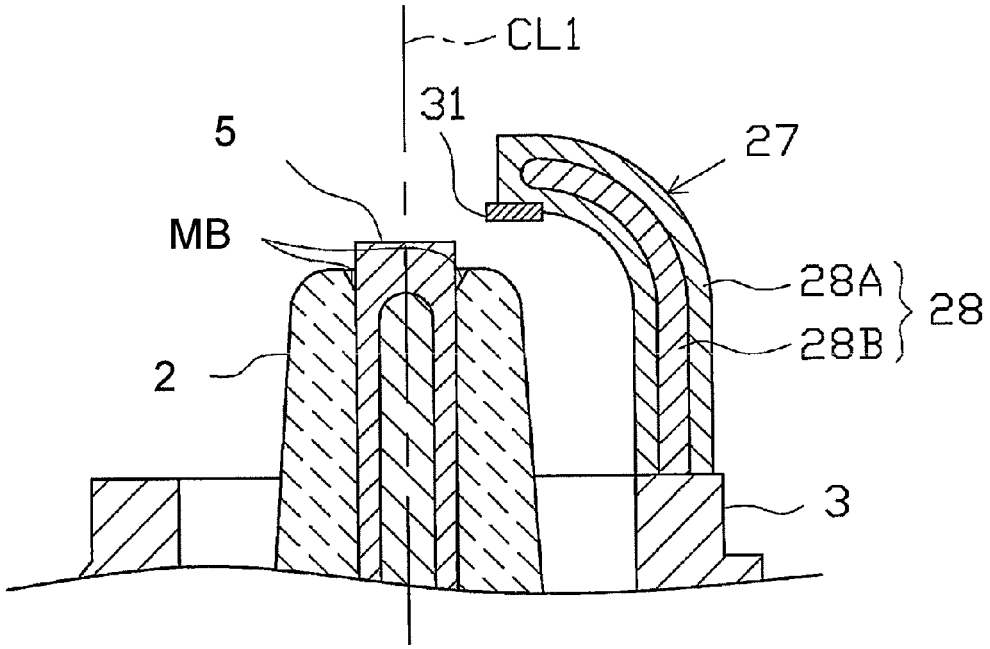
FIG. 7 is a partially sectioned expanded view of a front end portion of a spark plug according to another embodiment.

(b) In the above-mentioned embodiment, the ground electrode main body 28 has a single-layered structure made of a nickel alloy. However, as shown in FIG. 7, the ground electrode main body 28 may have a double-layered structure composed of an outer layer 28A and an inner layer 28B. In light of excellent durability and heat conduction of the ground electrode main body 28, the outer layer 28A is preferably formed of a nickel alloy (e.g., Inconel 600 or Inconel 601, both of which are registered trademarks). The inner layer 28B is preferably formed of pure copper or a copper alloy, which is a metal having a higher heat conductivity than that of the above-mentioned nickel alloy.

Figure 8:
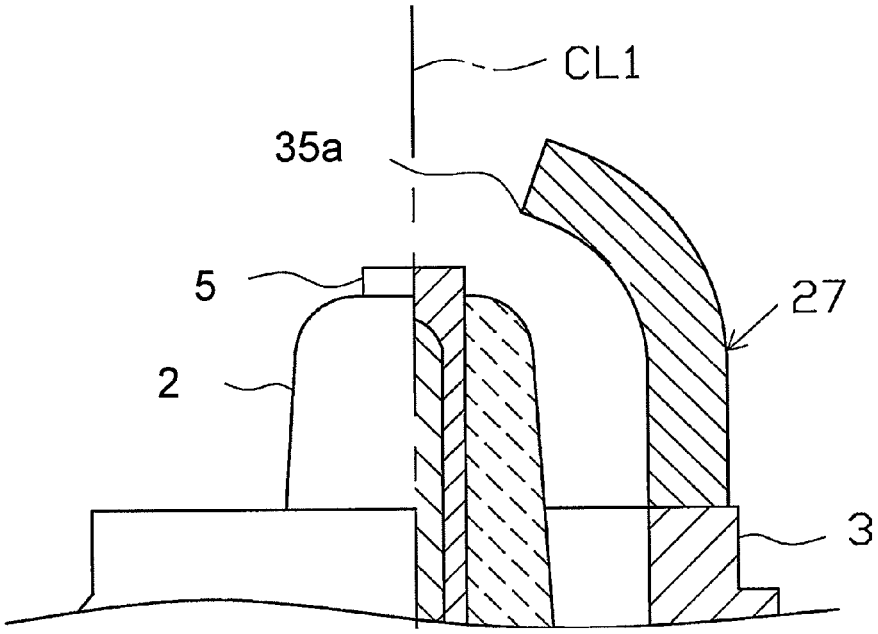
FIG. 8 is a partially sectioned expanded view of a front end portion of a spark plug according to another embodiment.

(c) In the above-mentioned embodiment, the front end portion of the ground electrode main body 28 extends perpendicular to the axis CL1 direction (left-hand side in the drawing). However, the shape of the ground electrode main body 28 is not limited to this shape. For example, the front end portion of the ground electrode main body 28 may extend obliquely upward as shown in FIG. 8. This turns to be advantageous when, for example, a joint portion of the metal shell 3 and the ground electrode 27 is made relatively small due to a reduced diameter of the metal shell 3 (e.g., a nominal diameter of the threaded portion 15 of the metal shell 3 is M10), which causes a difficulty in bending the ground electrode 27 at the time of adjusting the spark discharge gap 33.

In the above-mentioned embodiment, the ground electrode 27 is comprised of the ground electrode main body 28 and the noble metal portion 31 provided on the ground electrode main body 28. However, the ground electrode 27 may be comprised of only the ground electrode main body 28 without the noble metal portion 31, as shown in FIG. 8. In this case, the corner 35 of the ground electrode 27 serves as a corner 35*a* positioned in the front end portion of the ground electrode main body 28 on the ceramic insulator 2 side.

Figure 9:
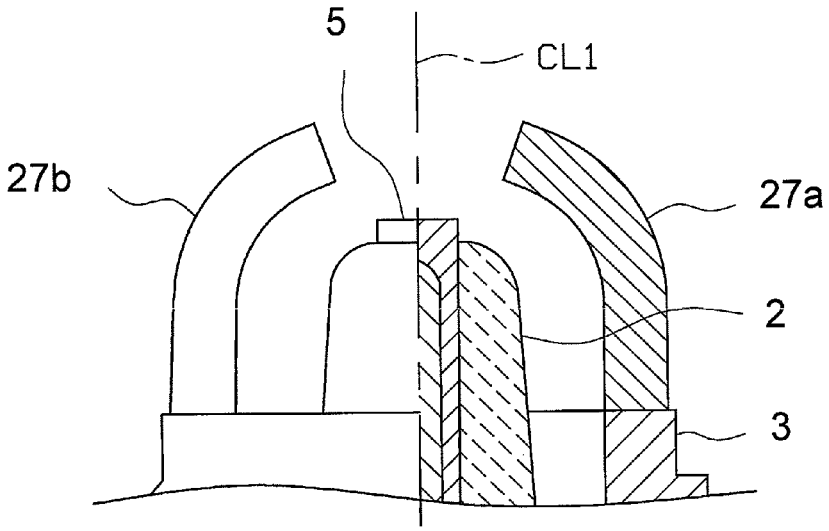
FIG. 9 is a partially sectioned expanded view of a front end portion of a spark plug according to another embodiment.

(d) Although only one ground electrode 27 is formed in the above-mentioned embodiment, as shown in FIG. 9, a plurality of ground electrodes 27*a* and 27*b* may be formed. In this case, a wider area which is fouled by carbon can be burnt off, whereby further improvement in anti-fouling characteristics is achievable.

Figure 10:
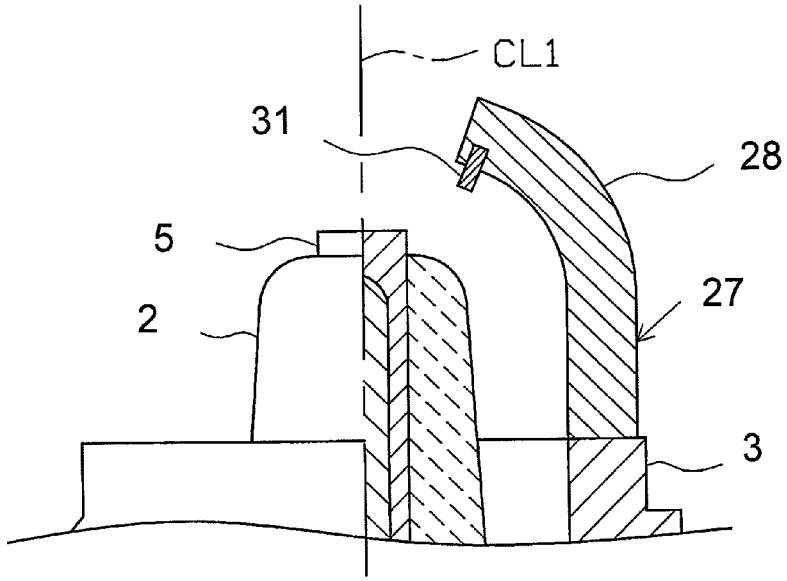
FIG. 10 is a partially sectioned expanded view of a front end portion of a spark plug according to another embodiment.
Figure 11:
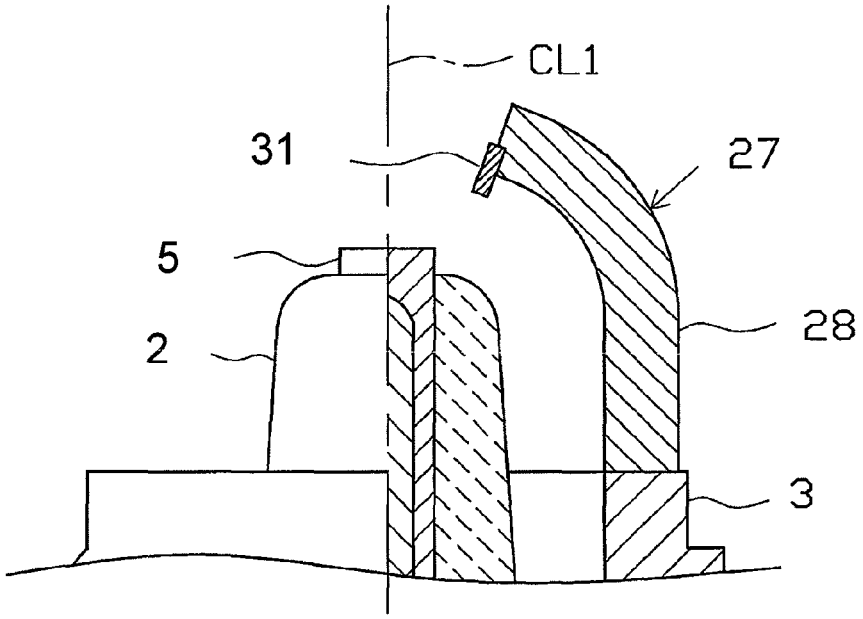
FIG. 11 is a partially sectioned expanded view of a front end portion of a spark plug according to another embodiment.

(e) One end portion of the noble metal portion 31 projects from the front end of the ground electrode main body 28 and the other end of the noble metal portion 31 is embedded in the ground electrode main body 28. However, allocation of the noble metal portion 31 in the ground electrode main body 28 is not limited to the above-mentioned embodiment. As shown in FIGS. 10 and 11, the noble metal portion 31 may be disposed so that the front end portion thereof projects from the ground electrode main body 28. At this time, as shown in FIG. 10, one end of the noble metal portion 31 may be entirely embedded in the side face of the ground electrode main body 28, or alternatively, only a part of the end may be embedded in the side face of the ground electrode main body 28 as shown in FIG. 11. With the noble metal portion 31 projecting from the ground electrode main body 28, it is possible to prevent the ground electrode main body 28 from conducting the heat of sparks (flame kernel), resulting in facilitating further improvement in ignitability.

Figure 12:
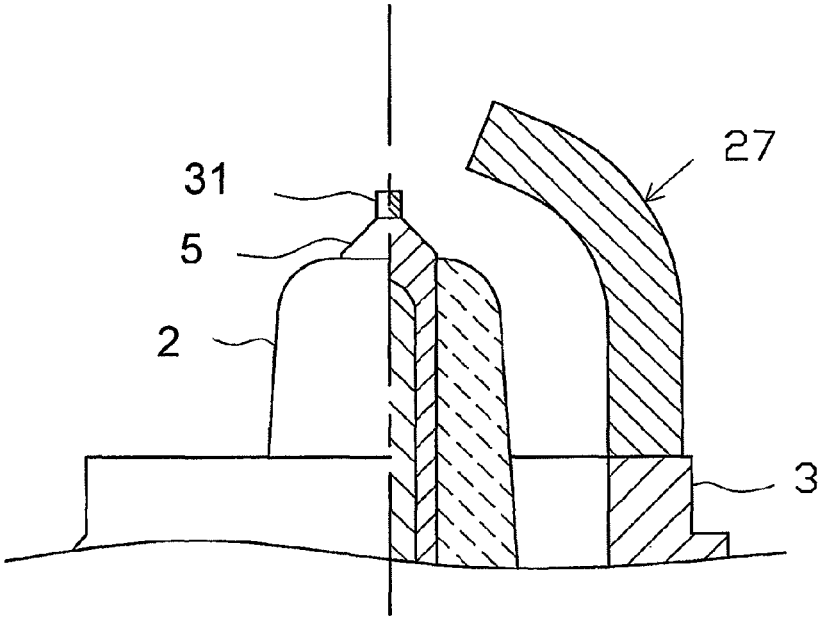
FIG. 12 is a partially sectioned expanded view of a front end portion of a spark plug according to another embodiment.

(f) Although it is not particularly indicated in the above-mentioned embodiment, the front end portion of the center electrode 5 may assume a tapered shape toward the axis CL1 direction as shown in FIG. 12. In this case, it is possible to prevent the center electrode 5 from conducting the heat of sparks (flame kernel), resulting in facilitating further improvement in ignitability. Furthermore, as shown in FIG. 12, the center electrode 5 may be provided with a cylindrical noble metal portion 32 made of a noble metal alloy on the front end portion thereof. The noble metal portion 32 enables to improve spark erosion resistance.

Figure 13:
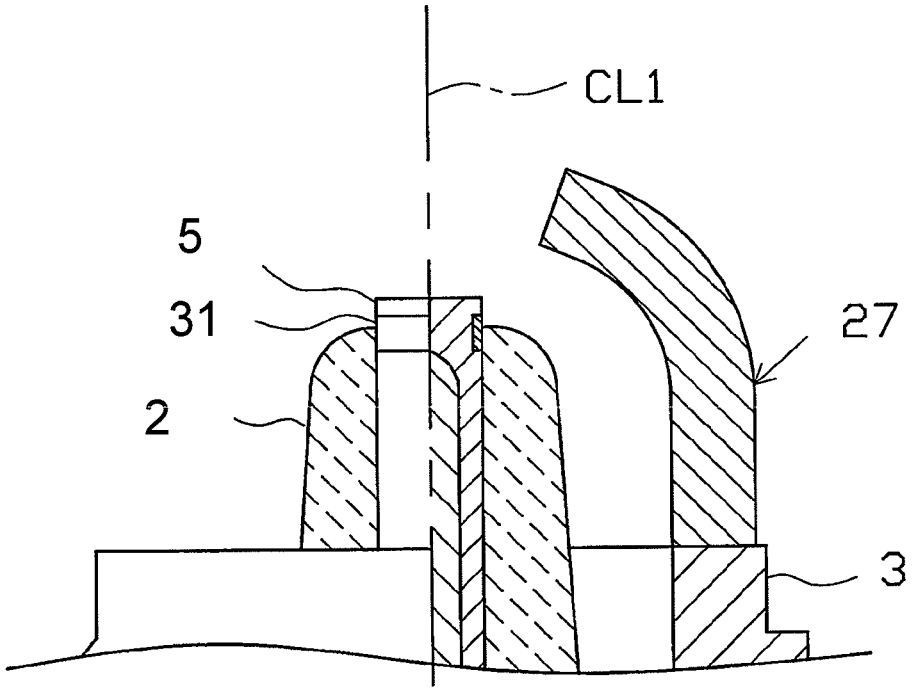
FIG. 13 is a partially sectioned expanded view of a front end portion of a spark plug according to another embodiment.

(g) Although it is not particularly indicated in the above-mentioned embodiment, as shown in FIG. 13, a noble metal portion 34 made of a noble metal alloy is formed on a portion of the center electrode 5 which faces the front end opening of the axial bore 4. In this case, when the spark discharge is generated through creeping on the ceramic insulator 2, an erosion of a side face of the center electrode 5 is prevented, resulting in facilitating the improvement in durability. In addition, the noble metal portion 34 may be formed on only a part of the portion (e.g., a location facing the ground electrode 27 side) instead of being formed on the entire portion facing the front end opening of the axial bore 4.

(h) According to the above-described embodiment, the ground electrode 27 (ground electrode main body 28) is joined to the front end portion 26 of the metal shell 3. However, a portion of the metal shell (or a portion of a front-end metal piece welded beforehand to the metal shell) may be cut so as to form the ground electrode (e.g., Japanese Patent Application Laid-Open (kokai) No. 2006-236906). Further, the ground electrode 27 may be joined to a side face of the front end portion 26 of the metal shell 3.

(i) In the above-described embodiments, the tool engagement portion 19 has a hexagonal cross section. However, the shape of the tool engagement portion 19 is not limited thereto. For example, the tool engagement portion may have a Bi-Hex (deformed dodecagon) shape [IS022977: 2005(E)] or the like.

The invention claimed is:

1. A spark plug for an internal-combustion engine, comprising:

a rod-like center electrode extending in an axis direction;

an insulator having an axial bore in the axis direction in which the center electrode is inserted;

a generally cylindrical metal shell provided on an outer circumference of the insulator;

a ground electrode extending from a front end portion of the metal shell and disposed so that a front end thereof is bent toward the center electrode;

a noble metal portion provided on the front end of the ground electrode which faces a front edge of the center electrode; and a gap formed between the ground electrode and the center electrode, wherein an entire front end portion of the ground electrode including the bent portion thereof is positioned outside of a virtual outer circumferential face that is formed by extending a front end outer circumferential face of the center electrode in the axis direction, and a terminating face of the ground electrode is positioned on a front end side in the axis direction with respect to a virtual face formed by extending a front end face of the center electrode, and wherein the following equation is satisfied:

$$1.1 \leq b/a \leq 1.6,$$

where "a" (*mm*) represents a first minimal distance between the front end portion of the center electrode and a point on the noble metal portion closest to the center electrode, and where "b" (*mm*) represents a second minimal distance between the front end portion of the insulator and the same point on the noble metal chip.

2. The spark plug for an internal-combustion engine according to claim 1, satisfying the following equation:

$$1.5 \leq b/a \leq 1.6$$

where "a" and "b" are as defined in claim 1.

3. The spark plug for an internal-combustion engine according to claim 1, wherein, when a front end opening of the axial bore and a corner positioned closest to the front end portion of the center electrode are projected on a virtual projection face perpendicular to the axis, an outer circumference length L of a projected axial bore between a first contact point and a second contact point on the ground electrode side occupies 40% or more of the outer circumference length of the projected axial bore, where the first contact point is defined by a first tangent drawn from a first edge that is positioned on an end of a projected corner serving as the corner projected on the virtual projection face to the projected axial bore serving as the front end opening of the axial bore projected on the virtual projection face, where the second contact point is defined by a second tangent drawn from a second edge that is positioned in the other end of the projected corner to the projected axial bore.

4. The spark plug for an internal-combustion engine according to claim 3, wherein the length L between the first and second contact points along the outer circumference of the projected axial bore on the ground electrode side occupies 50% or more of the outer circumference length of the projected axial bore.

5. The spark plug for an internal-combustion engine according to claim 1, which includes a tapered portion in a front end portion of the axial bore that tapers off toward the front end in the axis direction.

6. The spark plug for an internal-combustion engine according to claim 1, wherein a chamfered portion is formed in a front end opening of the axial bore.

7. The spark plug for an internal-combustion according to claim 1, wherein a plurality of ground electrodes is provided.

8. The spark plug for an internal-combustion according to claim 1, wherein the center electrode has a noble metal portion on at least a part of a portion facing the front end opening of the axial bore.

* * * * *